United States Patent [19]

Biblarz

[11] Patent Number: 4,988,925

[45] Date of Patent: Jan. 29, 1991

[54] OMNIDIRECTIONAL METAL HALIDE ARC DISCHARGE LAMP

[75] Inventor: Oscar Biblarz, Carmel, Calif.

[73] Assignee: GTE Products Corporation, Danvers, Mass.

[21] Appl. No.: 455,475

[22] Filed: Dec. 22, 1989

[51] Int. Cl.[5] ..... H05B 41/00; H05B 41/14; H05B 41/46

[52] U.S. Cl. ..... 315/334; 315/73; 315/88; 315/147; 313/307; 313/581

[58] Field of Search ..... 315/51, 56, 73, 88, 315/89, 147, 334; 313/307, 581

[56] References Cited

U.S. PATENT DOCUMENTS 3,611,015 10/1971 Kim ..... 315/265

*Primary Examiner*—David Mis

*Attorney, Agent, or Firm*—Joseph S. Romanow

[57] ABSTRACT

An arc discharge lamp which can be operated in any orientation without significant variation in performance includes an even number of electrodes at least equal to four, a discharge vessel including a spherical central portion and electrode mounting portions. The electrodes are mounted in the electrode mounting portions and have a substantially uniform three-dimensional distribution with respect to the central portion. The discharge lamp can be used in a lamp assembly including a switch apparatus for coupling electrical energy to a pair of the electrodes that is closest to a horizontal plane. An automatic switch apparatus includes orientation-sensitive switches, one having the same direction as each of the electrodes. The switches are interconnected such that electrical energy is coupled to a pair of electrodes in response to the orientation of the switch apparatus relative to a gravity field. The switch apparatus can be mounted in the base or within the lamp envelope of the lamp assembly.

32 Claims, 3 Drawing Sheets

OMNIDIRECTIONAL METAL HALIDE ARC DISCHARGE LAMP

FIELD OF THE INVENTION

This invention relates to metal halide are discharge lamps, and more particularly, to metal halide lamps of high wattage which can be operated in any orientation without significant variation in performance.

BACKGROUND OF THE INVENTION

Metal halide arc discharge lamps are widely used in commercial and industrial applications. A generally cylindrical arc tube contains a fill material including a starting gas, mercury and one or more metal halides. An electrode is located at each end of the arc tube. The arc tube is located within an outer envelope having a base for mounting the lamp and for connection to an electrical power source.

Metal halide lamps are sensitive to orientation. As a result, such lamps are usually designed either for vertical or horizontal operation. A metal halide lamp designed for vertical operation is disclosed in U.S. Pat. No. 4,812,714 issued Mar. 14, 1989 to Keeffe et al. A metal halide lamp designed for horizontal orientation is disclosed in U.S. Pat. No. 4,687,453 issued Aug. 18, 1987 to Lekebusch et al. In horizontal arc lamps, the arc arches upwardly due to an interaction between the arc and gravity. In practice, it is difficult to properly align these lamps.

When metal halide arc lamps, particularly those of 200 watts or greater, are operated at orientations other than the orientation for which they were designed, the operating life is typically reduced. Thus, it has been customary to take precautions to ensure that the lamp is installed with the proper orientation. It is sometimes inconvenient to operate a metal halide lamp in the orientation for which it was designed. In other cases, the lamp is inadvertently installed with the improper orientation, and the lamp life is reduced. It is thus desirable to provide, a metal halide arc lamp which is not sensitive to orientation.

Discharge lamps having more than two electrodes are known in the art. Metal vapor discharge lamps having three or more electrodes for operation from polyphase power are disclosed in U.S. Pat. No 2,265,323 issued Dec. 9, 1941 to Spanner and in British Patent No. 643,321 published Sept. 20, 1950. Operation from polyphase power is reported to reduce lamp flicker. A polyphase high pressure gas discharge lamp having a spherical lamp envelope and three electrodes is disclosed in Japanese Patent No. 64-86442 published Mar. 31, 1989. A discharge lamp having $2n+1$ electrodes to provide $2n$ discharge passages is disclosed in French Patent No. 959,659 published Apr. 3, 1950.

It is a general object of the present invention to provide improved arc discharge lamps.

It is another object of the present invention to provide arc discharge lamps which can be operated in any orientation in a gravity field.

It is yet another object of the present invention to provide arc discharge lamps which have a long operating life.

It is a further object of the present invention to provide arc discharge lamps which can be operated at different power levels.

It is a further object of the present invention to provide an arc discharge lamp wherein operating power is automatically applied to a selected pair of electrodes.

It is yet another object of the present invention to provide an arc discharge lamp having an electrode configuration which permits operation in any orientation without substantial reduction in the operating life of the lamp.

It is still another object of the present invention to provide arc discharge lamps which are easily installed.

SUMMARY OF THE INVENTION

According to the present invention, these and other objects and advantages are achieved in an arc discharge lamp comprising an even number of electrodes at least equal to four, a sealed light-transmissive discharge vessel including a central portion and electrode mounting portions and a fill material in the discharge vessel for supporting an arc discharge when electrical energy is coupled to the electrodes. An electrode is mounted in each of the electrode mounting portions. The electrodes have a substantially uniform three-dimensional distribution with respect to the central portion.

Typically, the central portion is substantially spherical, and the lamp includes four electrodes, each equally spaced from the other three. Each of the electrode mounting portions of the discharge vessel includes means defining a recess extending outwardly from the central portion to a feedthrough portion in which the electrode is sealed.

The positions of the electrodes relative to the central portion of the discharge vessel can be defined in a spherical coordinate system having an origin at the center of the central portion. The electrodes are distributed substantially uniformly relative to the spherical coordinate system. For a discharge lamp having four electrodes, the angles between the electrodes in the spherical coordinate system are 109.5°.

The discharge lamp includes means for starting an arc discharge in the discharge vessel. The starting means can include starting electrodes within the discharge vessel. Alternatively, the starting means includes means external to the discharge vessel for generating ultraviolet radiation.

In a preferred embodiment, the discharge lamp is utilized in a discharge lamp assembly which is insensitive to orientation, and means is provided for coupling electrical energy to a pair of the electrodes that is closest to a horizontal plane. The coupling means can include manual switching means for connecting the pair of electrodes that is closest to a horizontal plane to a source of electrical energy. Alternatively, the coupling means can include means for automatically switching electrical energy to the pair of electrodes to be energized. The automatic switching means is mechanically coupled to the discharge vessel and is responsive to the orientation of the discharge vessel relative to a horizontal plane.

In a preferred embodiment, the automatic switching means includes at least four switches, each of the switches having an output line and a switch axis, the state of each switch being responsive to the orientation of the switch axis relative to a gravity field, means for mounting the switches such that the directions of the switch axes have a substantially uniform three dimensional distribution, and means for interconnecting the switches to an electrical power source such that electrical power is coupled to a pair of the output lines in response to the orientation of the apparatus relative to the gravity field. The switches in the automatic switching means are mounted such that one switch axis corresponds to the orientation of each electrode in the discharge lamp. The switches are preferably mercury switches having single pole, double throw operation.

According another aspect of the invention, there is provided a high pressure arc discharge lamp assembly comprising an arc discharge lamp, including an even number of electrodes at least equal to four and a sealed light-transmissive discharge vessel having a central portion and electrode support portions, one of the electrodes being mounted in each of the electrode support portions, a sealed light-transmissive outer envelope, means for mechanical support of the arc discharge lamp in the outer envelope and means for coupling electrical energy to a selected pair of electrodes. The electrodes have a substantially uniform three dimensional distribution with respect to the central portion of the discharge vessel.

In a preferred embodiment, automatic switching means is mounted in a base or within the outer envelope of the discharge lamp assembly. As the discharge lamp assembly is positioned in different orientations, electrical energy is automatically coupled to a pair of electrodes which is closest to a horizontal plane.

In one embodiment of the invention, each of the electrodes is positioned at the same radius from the center of the spherical central portion of the discharge vessel. In this embodiment, the discharge lamp has approximately the same operating power level for any pair of electrodes that is energized.

In another embodiment of the invention, the electrodes are positioned at different radii from the center of the spherical central portion of the discharge vessel. In this embodiment, the distances between different electrodes are different, and the operating power level of the discharge lamp depends on the pair of electrodes that is energized.

According to another feature of the invention, when one or more of the electrodes in the discharge lamp fails, the orientation of the lamp is changed, and other electrodes are energized to provide extended life operation.

According to still another feature of the invention, polyphase power is applied to the discharge lamp.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

An arc discharge lamp in accordance with the present invention includes a light-transmissive discharge vessel and an even number of electrodes at least equal to four. The discharge vessel includes a central portion and electrode mounting portions. The electrodes are mounted in a generally radial configuration and have a uniform or nearly uniform three dimensional distribution with respect to the central portion of the discharge vessel. The discharge vessel contains a fill material for supporting an arc discharge. In typical operation, electrical energy is applied to a selected pair of the electrodes, and an arc discharge occurs in the central portion of the discharge vessel between the pair of electrodes to which electrical energy is applied.

Figure 1:
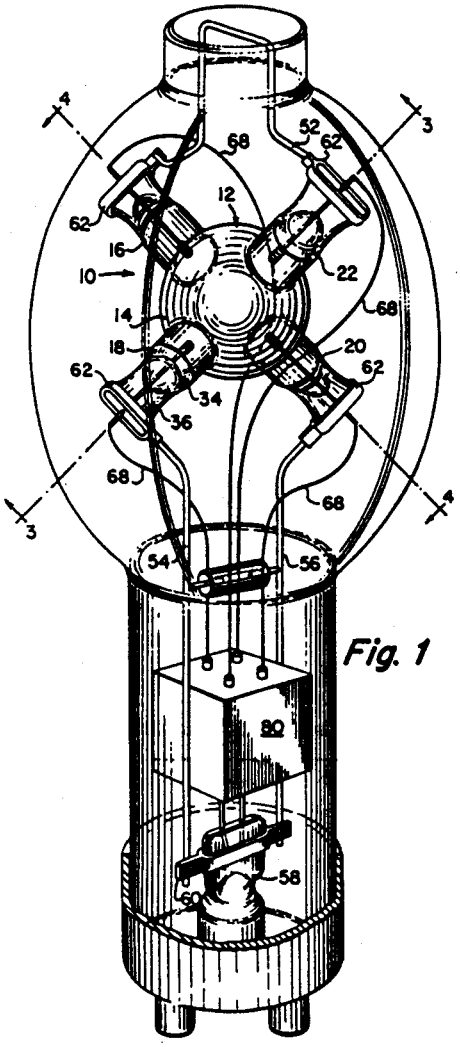
FIG. 1 is an elevational view of an arc discharge lamp assembly in accordance with the present invention.
Figure 3:
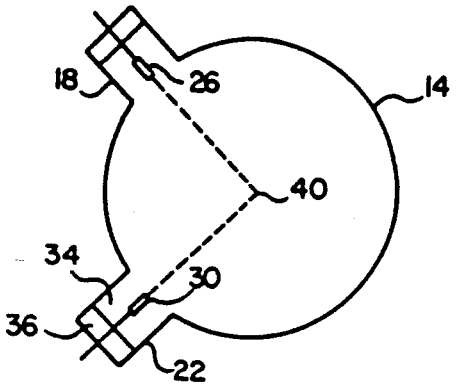
FIG. 3 is a cross-section taken along the line 3—3 of FIG. 1.
Figure 4:
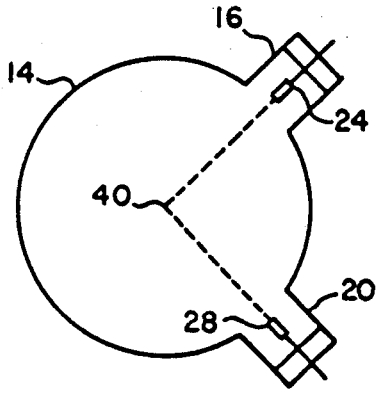
FIG. 4 is a cross-section taken along the line 4—4 of FIG. 1.

A four electrode discharge lamp in accordance with the invention is shown in FIGS. 1, 3 and 4. An arc discharge lamp 10 includes a light-transmissive discharge vessel 12 having a central portion 14 and outwardly extending electrode mounting portions 16, 18, 20 and 22. The discharge vessel 12 is typically fabricated of quartz and is hermetically sealed. The central portion 14 of the discharge vessel preferably has a generally spherical shape. Electrodes 24, 26, 28 and 30 are mounted in electrode mounting portions 16, 18, 20 and 22, respectively. The electrodes 24, 26, 28 and 30 can comprise conventional electrodes, each including a tungsten rod having a tungsten wire coil wound at or near its end. The electrode rods are radially oriented with respect to the center of spherical central portion 14.

The electrode mounting portions 16, 18, 20 and 22 include recesses 34 for mounting of the respective electrodes, and seal regions 36. The recesses 34 permit the electrodes 24, 26, 28 and 30 to be mounted in the discharge vessel 12 near the periphery of the spherical central portion 14 of the discharge vessel or extending into the central portion 14 by a predetermined distance. The seal regions 36 include an electrical feedthrough for coupling of electrical energy from an external source to the respective electrode. In a preferred embodiment, the seal regions 36 comprise press seals utilizing thin molybdenum ribbons, as is well known in the field of metal halide arc discharge lamps. The discharge lamp 10 contains a fill material including a starting gas, mercury and metal halides for supporting an arc discharge when electrical energy is applied to the electrodes. Fill material compositions for metal halide lamps are well known in the art. The diameter of the spherical central portion 14 is selected depending on the desired lamp wattage. For a 400 watt lamp, the diameter of central portion is in the range of 2.5 to 3.5 centimeters and is preferably about 3 centimeters.

Figure 2:
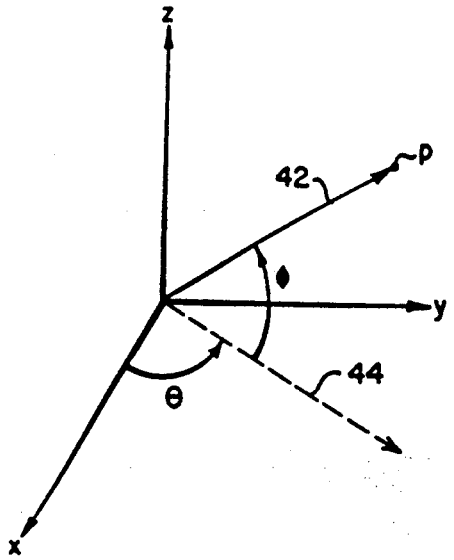
FIG. 2 shows a spherical coordinate system in which the positions of the electrodes in the discharge lamp of FIG. 1 are defined.

As indicated above, the electrodes 24, 26, 28 and 30 preferably have a substantially uniform three dimensional distribution with respect to central portion 14. The electrode positions can be defined with reference to a spherical coordinate system as shown in FIG. 2. The spherical coordinate system has an origin which corresponds to the center 40 of the spherical central portion 14 of the discharge vessel 12. The X and Y directions define a horizontal plane, and the Z direction is vertical. The position P of an electrode in the spherical coordinate system is defined by a line 42 between point P and the origin of the coordinate system. The projection of line 42 in the X Y plane is along line 44. An angle $\theta$ defines the elevation of line 44 relative to the X axis, and an angle Φ defines the elevation of line 42 relative to line 44. For a discharge lamp having four uniformly distributed electrodes, the electrodes have the following coordinates in the spherical system:

(a) Electrode 1: $\Phi=0$, $\theta=+54.74°$,
(b) Electrode 2: $\Phi=0$, $\theta=-54.74°$,
(c) Electrode 3: $\Phi=+54.74°$, $\theta=+180°$, and
(d) Electrode 4: $\Phi=-54.74°$, $\theta=180°$.

The angle a (FIGS. 3 and 4) between electrodes in the spherical coordinate system is 109.5° for a four electrode discharge lamp. In a discharge lamp having six electrodes, the angle between adjacent electrodes is 90°. It will be understood that the X, Y and Z directions in FIG. 2 are arbitrarily selected to illustrate the positions of the electrodes relative to each other.

As discussed hereinafter, the radial distance of each electrode from the center 40 of the spherical portion 14 can be equal or different, depending on the intended operating conditions. For four electrodes located at equal radial distances from center 40 and positioned as described above, each electrode is equally spaced from every other electrode.

As discussed above, the discharge lamp of the present invention includes an even number of electrodes at least equal to four. A discharge lamp having four electrodes is considered the most practical. However, for discharge lamps having six, eight or more electrodes, the electrodes should have a substantially uniform three dimensional distribution with respect to the central portion of the discharge lamp.

A discharge lamp assembly incorporating discharge lamp 10 is shown in FIG. 1. The discharge lamp 10 is mounted in a sealed, light-transmissive outer envelope 50, typically, fabricated of glass. The discharge lamp 10 is supported within lamp envelope 50 by frame members 52, 54 and 56, each of which comprises a rigid metal rod. Frame members 54 and 56 are connected to a lamp stem 58 by a metal strap 60. Frame member 52 is retained in a recess in the upper portion of lamp envelope 50. A metal strap 62 engages the seal region 36 of each of the electrode mounting portions 16, 18, 20 and 22. The straps 62 for electrode mounting portions 16 and 22 are welded to opposite ends of frame member 52, and straps 62 for electrode mounting portions 18 and 20 are welded to frame members 54 and 56, respectively. It will be understood that different mechanical configurations can be utilized for mounting of discharge lamp 10 in outer envelope 50. Electrical power for operation of discharge lamp 10 is coupled through a lamp base 66, lamp stem 58 and electrical leads 68 to each of the electrodes 24, 26, 28 and 30. A switch apparatus 80 for selecting a pair of the electrodes 24, 26, 28 and 30 to be energized can be mounted in the lower portion of lamp envelope 50 as shown in FIG. 1. The switch apparatus 80 is described in detail below. Alternatively, the switch apparatus 80 can be mounted in lamp base 66.

A primary application of the above-described discharge lamp is in a lamp configuration which operates in any orientation with essentially the same performance. Electrical power is applied to a pair of the electrodes which is closest to a horizontal plane, and the remaining electrodes are not energized. An arc discharge extends through the spherical portion of discharge vessel 12 between the electrode pair to which electrical power is applied. In the above-described discharge lamp, a pair of electrodes is close to a horizontal plane for any lamp orientation. The application of electrical power to a pair of electrodes can be effected by manual switching or by an automatic switching apparatus, as described hereinafter, which senses the orientation of the discharge lamp and automatically applies electrical power to the electrode pair which is closest to a horizontal plane.

A metal halide arc discharge lamp requires a starting device to initiate discharge. Known starting arrangements include starting electrodes sealed in the lamp envelope adjacent to one of the main electrodes, ultraviolet starting sources as disclosed in U.S. Pat. No. 4,812,714 issued Mar. 14, 1989 to Keeffe et al and spark gap devices positioned in proximity to the arc tube. Any of the known starting techniques can be utilized for starting the discharge lamp of the present invention. A starting device positioned adjacent to the arc tube is preferred, since this configuration is independent of which electrodes are energized and requires no extra electrodes. When starting electrodes are utilized, a starting electrode must be provided with each electrode to insure that a starting electrode is available for any selected electrode pair.

A discharge lamp having the general configuration of discharge lamp 10 shown in FIG. 1 and described hereinabove was constructed. The arc tube was constructed from 400 watt electrodes press sealed into 250 watt quartz arc tube ends. The arc tube ends were mounted on a 3 cm diameter quartz sphere. The fill material in the arc tube included a conventional metal halide fill material and extra thorium. The arc tube was mounted in a 400 watt outer envelope containing nitrogen at a pressure of about one-third atmosphere. The electrode mounting portions were insulated with quartz wool to reduce heat loss in these regions. With insulation around the electrode mounting portions, the lamp had a five minute warm-up time. A Tesla coil was used for starting. Manual switching of power to the different electrodes was utilized. The lamp was tested in three orientations, and the results are summarized in Table I below.

TABLE 1

| ORIENTATION | WATTS | LUMENS/ WATT | CRI | COLOR TEMP |
|---|---|---|---|---|
| Base Up | 375 | 67.15 | 49.3 | 4089 |
| " | 350 | 64.97 | 46.3 | 4105 |
| Horizontal | 400 | 72.13 | 51.2 | 3672 |
| " | 375 | 70.72 | 48.7 | 3689 |
| " | 350 | 68.23 | 47.1 | 3829 |
| Base Down | 400 | 68.83 | 51.0 | 3877 |
| " | 375 | 67.65 | 49.1 | 3957 |
| " | 350 | 66.12 | 47.8 | 4066 |

As indicated hereinabove, electrical energy can be coupled to a selected pair of electrodes of discharge lamp 10 with a manual switching arrangement or an automatic switching arrangement. In a manual switching arrangement, a switch is connected in series with each cf the electrodes 24, 26, 28 and 30. For a given orientation of the lamp assembly, the two electrodes that are closest to horizontal are identified, and the corresponding switches are closed. Power is applied to the two electrodes that are closest to horizontal, and the remaining electrodes remain deenergized.

Figure 5:
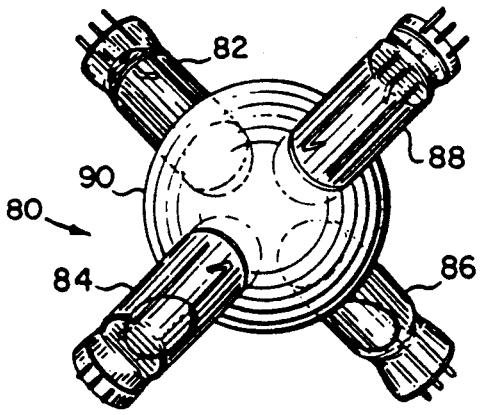
FIG. 5 is a perspective view of a switch assembly for controlling the discharge lamp of FIG. 1.
Figure 6:
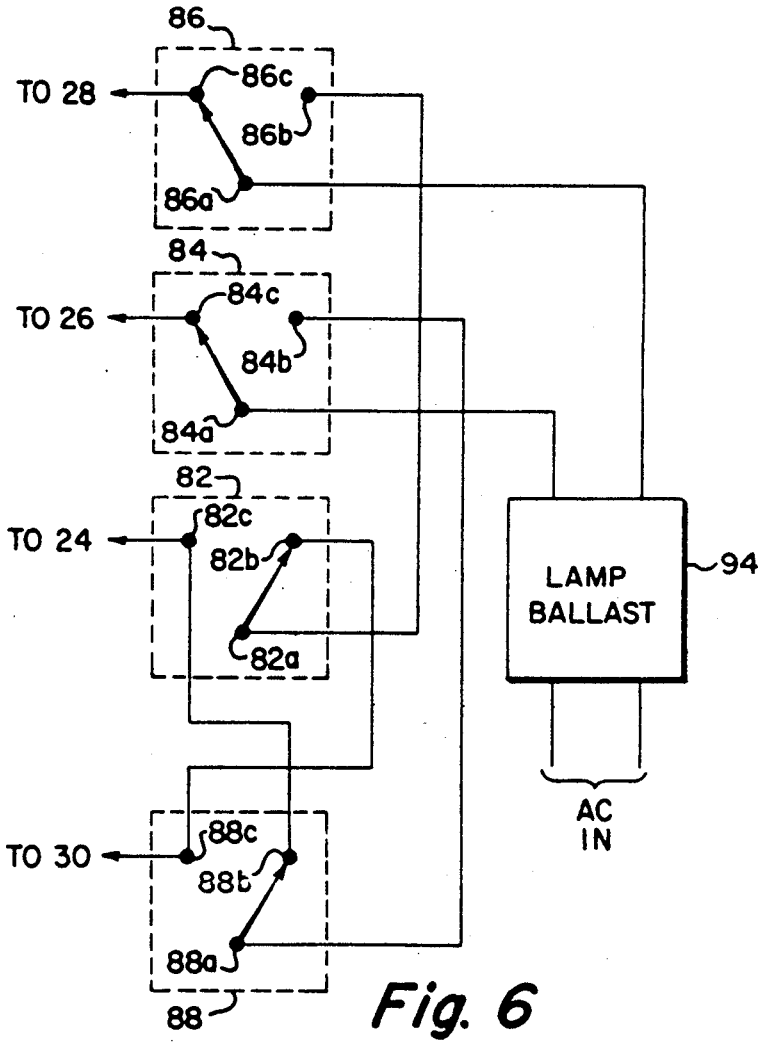
FIG. 6 is a schematic diagram illustrating the wiring of the switches shown in FIG. 5.

Automatic switching apparatus is illustrated in FIGS. 5 and 6. The switching apparatus utilizes a plurality of gravity-sensitive, or orientation-sensitive, switches. The number of switches is equal to the number of electrodes in the discharge lamp 10. The switches are mounted such that one switch has the same orientation as each electrode in the discharge lamp. Referring to FIG. 5, a switch apparatus 80 includes orientation sensitive switches 82, 84, 86 and 88 in a mounting fixture 90.

Each switch has a longitudinal axis. The state of the switch depends on the orientation of the switch axis relative to a horizontal plane. An example of such a switch is a mercury switch having mercury sealed in a tube having electrodes. When the switch axis is oriented at a positive angle with respect to the horizontal plane, the mercury is at one end of the tube, and a first set of contacts is closed. When the switch axis is oriented at a negative angle with respect to the horizontal plane, the mercury is at the other end of the tube and a second set of contacts is closed. The mercury completes an electrical connection between electrodes located within the tube. An example of such a switch is a standard three electrode mercury switch having a single-pole, double-throw configuration. It will be understood that any type of orientation-sensitive switch can be utilized in the switch apparatus of the invention.

The switch apparatus 80 is mounted in a fixed relationship to the discharge lamp 10. The switches 82, 84, 86 and 88 are mounted in fixture 90 with orientations that correspond to the orientations of electrodes 24, 26, 28 and 30, respectively. Thus, the orientation of the longitudinal axis of switch 82 corresponds to the orientation of electrode 24, the orientation of the axis of switch 84 corresponds to the orientation of electrode 26, the orientation of the axis of switch 86 corresponds to the orientation of electrode 28, and the orientation of the axis of switch 88 is the corresponds to the orientation of electrode 30.

An example of a wiring arrangement for automatically coupling electrical power to a pair of electrodes in discharge lamp 10 is shown in FIG. 6. AC power is coupled to a lamp ballast 94, which can be a conventional inductive ballast of the type used with metal halide lamps. Each of the switches 82, 84, 86 and 88 is represented as having a normally open contact, a normally closed contact and a common contact. The output of the lamp ballast 94 is coupled to the contacts 86*a* and 84*a* of switches 86 and 84, respectively. Contact 86*b* of switch 86 is connected to contact 82 a of switch 82, and contact 84*b* of switch 84 is connected to contact 88*a* of switch 88. Contact 82*b* of switch 82 is connected to contact 88*c* of switch 88, and contact 82*c* of switch 82 is connected to contact 88*b* of switch 88. Contacts 82*c*, 84*c*, 86*c* and 88*c* of the respective switches are connected to electrodes 24, 26, 28 and 30, respectively, of discharge lamp 10.

In operation, two of the switches in the switch apparatus 80 that are oriented below a horizontal plane are both in a first state. Electrical power is coupled to the electrodes corresponding to those two switches. The other two switches in switch apparatus 80 are above the horizontal plane and are both in a second state. Power is not coupled to the electrodes corresponding to those two switches. In the example of FIG. 6, switches 84 and 86 are oriented so as to couple power to electrodes 26 and 28, respectively, and switches 82 and 88 are oriented so that power is not connected to electrodes 24 and 30. For different orientations of the switching apparatus, electrical power is coupled to different pairs of electrodes. For certain limited orientations, power may simultaneously be coupled to three electrodes. In this situation, ordinary variations in electrode structure and electrode spacings insure that an arc is formed between only two of the electrodes.

It will be understood that for discharge lamps having more than four electrodes, a corresponding number of orientation-sensitive switches is provided. One switch is provided for each electrode of the discharge lamp, and the switches are mounted with the same orientations as the electrodes.

As described above, the primary application of the discharge lamp of the present invention is in a lamp assembly that is independent of orientation. Another application is to provide a discharge lamp having extended life. In order to provide extended life, the discharge lamp is operated in one orientation with a selected pair of electrodes energized. After the selected pair of electrodes has degraded or failed due to extended operation, the lamp orientation is changed, and a different pair of electrodes is energized. Thus, the lamp operating life is extended in comparison with lamps having a single pair of electrodes.

In another application, the discharge lamp of the present invention is operated at different power levels. In this case, the electrodes are positioned at different radial distances from the center of the spherical central portion 14. Thus, the spacings between different pairs of electrodes are different, and different voltages are developed between different pairs of electrodes. The operating power level of the lamp is changed by energizing an electrode pair with a different spacing.

In another application, the electrodes of the discharge lamp shown and described herein are energized with polyphase power.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An arc discharge lamp comprising:

an even number of electrodes at least equal to four;

a sealed, light-transmissive discharge vessel including a central portion and electrode mounting portions, one of said electrodes being mounted in each of said electrode mounting portions, said electrodes having a substantially uniform three-dimensional distribution with respect to said central portion; and a fill material in said discharge vessel for supporting an arc discharge when electrical energy is coupled to said electrodes.

2. An arc discharge lamp as defined in claim 1 wherein the central portion of said discharge vessel is substantially spherical.

3. An arc discharge lamp as defined in claim 1 including four electrodes, each equally spaced from the other three in three dimensional space.

4. An arc discharge lamp as defined in claim 1 wherein said fill material includes metal halides.

5. An arc discharge lamp as defined in claim 2 wherein said electrodes are radially oriented with respect to said spherical central portion.

6. An arc discharge lamp as defined in claim 1 wherein each of the electrode mounting portions of said discharge vessel includes means defining a recess extending outwardly from said central portion to a feed-through portion in which one of said electrodes is sealed.

7. An arc discharge lamp as defined in claim 1 wherein said discharge vessel comprises quartz.

8. An arc discharge lamp as defined in claim 2 wherein said spherical central portion has a diameter in the range of 2.5 to 3.5 centimeters.

9. An arc discharge lamp as defined in claim 2 wherein said spherical central portion has a diameter of about three centimeters.

10. An arc discharge lamp as defined in claim 2 wherein the positions of said electrodes relative to said spherical central portion are defined in a spherical coordinate system having an origin at the center of said spherical central portion, an azimuthal angle $\theta$ and an elevational angle $\Phi$ and wherein said discharge lamp includes four electrodes located in said spherical coordinate system at $\Phi=0$, $\theta=+54.74°$; $\Phi=0$, $\theta=-54.74°$; $\Phi=+54.74°$, $\theta=180°$; and $\theta=-54.74°$, $\theta=180°$.

11. An arc discharge lamp as defined in claim 1 wherein the positions of said electrodes relative to said central portion are defined in a spherical coordinate system having an origin at the center of said central portion and wherein said discharge lamp includes four electrodes and wherein the angles between electrodes in said spherical coordinate system are 109.5°.

12. An arc discharge lamp as defined in claim 1 wherein the positions of said electrodes relative to the central portion of said discharge vessel are defined in a spherical coordinate system having an origin at the center of said central portion and wherein said electrodes are distributed substantially uniformly relative to said spherical coordinate system.

13. An arc discharge lamp as defined in claim 1 further including means for starting an arc discharge in said discharge vessel.

14. An arc discharge lamp as defined in claim 1 further including means for coupling electrical energy to a selected pair of said electrodes.

15. An arc discharge lamp as defined in claim 14 wherein said coupling means includes manual switching means.

16. An arc discharge lamp as defined in claim 14 wherein said coupling means includes means for automatically coupling electrical energy to a pair of said electrodes which is closest to a horizontal plane.

17. An arc discharge lamp as defined in claim 16 wherein said means for automatically coupling electrical energy includes switching means mechanically coupled to said discharge vessel, said switching means being responsive to the orientation of said discharge vessel relative to said horizontal plane.

18. An arc discharge lamp as defined in claim 12 wherein said electrodes are located at approximately the same radii relative to the origin of said spherical coordinate system.

19. An arc discharge lamp as defined in claim 12 wherein said electrodes are located at different radii relative to the origin of said spherical coordinate system.

20. An arc discharge lamp assembly comprising:

an arc discharge lamp comprising an even number of electrodes at least equal to four and a sealed, light transmissive discharge vessel including a central portion and electrode mounting portions, one of said electrodes being mounted in each of said electrode mounting portions, said electrodes having a substantially uniform three-dimensional distribution with respect to said central portion, said arc discharge lamp further including a fill material within said discharge vessel for supporting an arc discharge;

a sealed light-transmissive outer envelope;

means for mechanical support of said arc discharge lamp in said outer envelope; and means for coupling electrical energy to a selected pair of said electrodes.

21. An arc discharge lamp assembly as defined in claim 20 wherein the central portion of said discharge vessel is substantially spherical.

22. An arc discharge lamp assembly as defined in claim 20 including four electrodes, each equally spaced from the other three.

23. An arc discharge lamp assembly as defined in claim 20 wherein said fill material includes metal halides.

24. An arc discharge lamp assembly as defined in claim 21 wherein the positions of said electrodes relative to said spherical central portion are defined in a spherical coordinate system having an origin at the center of said spherical central portion, an azimuthal angle $\theta$ and an elevational angle $\Phi$ and wherein said discharge lamp includes four electrodes located in said spherical coordinate system at $\Phi=0$, $\theta=+54.74°$; $\Phi=0$, $\theta=-54.74°$; $\Phi=+54.74°$, $\Phi=180°$; and $\Phi=-54.74°$, $\Phi=180°$.

25. An arc discharge lamp assembly as defined in claim 20 further including means for starting an arc discharge in said discharge vessel.

26. An arc discharge lamp assembly as defined in claim 20 wherein said coupling means includes means for automatically coupling electrical energy to a pair of said electrodes which is closest to a horizontal plane.

27. An arc discharge lamp assembly as defined in claim 26 wherein said means for automatically coupling electrical energy includes switching means mechanically coupled to said discharge vessel, said switching means being responsive to the orientation of said discharge vessel relative to said horizontal plane.

28. An arc discharge lamp assembly as defined in claim 27 wherein said switching means comprises at least four switches, each of said switches having a switch axis and an output line coupled to one of said electrodes, the state of each of said switches being responsive to the orientation of said switch axis relative to a gravity field, means for mounting said switches such that the directions of said switch axes have a substantially uniform, three-dimensional distribution corresponding to the distribution of said electrodes, and means for interconnecting said switches to an electrical power source such that electrical power is coupled through a pair of said output lines to said electrodes in response to the orientation of said lamp assembly relative to said gravity field.

29. An arc discharge lamp assembly as defined in claim 28 wherein said switches comprise mercury switches.

30. An arc discharge lamp assembly as defined in claim 27 further including a lamp base having said switching means mounted therein.

31. An arc discharge lamp comprising:

an even number of electrodes at least equal to four;

a sealed, light-transmissive discharge vessel including a central portion and electrode mounting portions, one of said electrodes being mounted in each of said electrode mounting portions;

a fill material in said discharge vessel for supporting an arc discharge; and means for coupling electrical energy to a pair of said electrodes selected for operation and for maintaining the remaining electrodes in a deenergized state.

32. An arc discharge lamp comprising:

four electrodes;

a sealed, light-transmissive discharge vessel including a spherical central portion and means for mounting said electrodes in said discharge vessel and for coupling electrical energy to said electrodes, said electrodes being mounted in said discharge vessel with a substantially uniform three dimensional distribution with respect to the spherical central portion; and a fill material within said discharge vessel for supporting an arc discharge.

* * * * *